US007181945B2

(12) United States Patent
Park et al.

(10) Patent No.: US 7,181,945 B2
(45) Date of Patent: Feb. 27, 2007

(54) SEMI-MANUFACTURE PULLEY FORMING APPARATUS

(75) Inventors: Dae-Kyu Park, Daejeon-si (KR); Tae-Hyoung Eum, Daejeon-si (KR); Jae-Hyeon Hur, Daejeon-si (KR)

(73) Assignee: Halla Climate Control Corporation, Daejeon-si (KR)

( * ) Notice: Subject to any disclaimer, the term of this patent is extended or adjusted under 35 U.S.C. 154(b) by 106 days.

(21) Appl. No.: 11/066,280

(22) Filed: Feb. 28, 2005

(65) Prior Publication Data

US 2005/0138808 A1 Jun. 30, 2005

Related U.S. Application Data

(62) Division of application No. 10/422,721, filed on Apr. 25, 2003, now Pat. No. 6,865,808.

(30) Foreign Application Priority Data

Apr. 25, 2002 (KR) ..... 2002-022622

(51) Int. Cl.
*B21D 22/00* (2006.01)
*B21K 1/42* (2006.01)

(52) U.S. Cl. ..... 72/84; 72/85; 72/110; 29/892

(58) Field of Classification Search ..... 72/82, 72/83, 84, 85, 71, 110; 29/892, 892.11, 892.2, 29/892.3, 894.362

See application file for complete search history.

(56) References Cited

U.S. PATENT DOCUMENTS

| | | | | |
|---|---|---|---|---|
| 5,829,291 | A * | 11/1998 | Tanaka et al. | 72/71 |
| 5,904,060 | A | 5/1999 | Kanemitsu et al. | |
| 5,951,422 | A | 9/1999 | Roes et al. | |
| 5,987,952 | A * | 11/1999 | Kutzscher et al. | 72/71 |
| 6,302,971 | B1 * | 10/2001 | Ohara et al. | 148/210 |
| 6,434,991 | B1 | 8/2002 | Jaschka | |
| 6,463,659 | B2 * | 10/2002 | Shohara et al. | 29/892.3 |
| 6,688,149 | B2 * | 2/2004 | Friese | 72/71 |
| 2001/0035035 | A1 | 11/2001 | Rose et al. | |
| 2001/0035036 | A1 | 11/2001 | Monathan et al. | |

* cited by examiner

*Primary Examiner*—Ed Tolan
(74) *Attorney, Agent, or Firm*—Lowe, Hauptman & Berner LLP

(57) ABSTRACT

A pulley is made by fixing an edge of an opening of a plate by using a first upper mandrel ring installed at a lower end of a first supporting pin of a first forming device. A supporting block disposed around an upper end of a first spindle is rotated with the first spindle. An inner hub of the pulley is formed by inwardly pressing an upper surface of the plate against a first pressing roller to reduce the thickness of the plate while drawing the plate around a first mandrel ring. The plate is fixed to a second spindle of a second forming device, so the plate rotates with the second spindle. An outer hub is formed by pressing a convex bead toward the inner hub by using a fourth pressing roller and by drawing the outer hub.

5 Claims, 9 Drawing Sheets

SEMI-MANUFACTURE PULLEY FORMING APPARATUS

CROSS-REFERENCE TO RELATED APPLICATIONS

This application is a Divisional application of U.S. application Ser. No. 10/422,721 now U.S. Pat. No. 6,865,808, filed Apr. 25, 2003, which claims the priority of Korean Application Serial No. 2002-022622, filed Apr. 25, 2002, both applications hereby being incorporated by reference.

BACKGROUND OF THE INVENTION

1. Field of the Invention

The present invention relates to a device for forming a pulley, and more particularly, to a device for forming a pulley of an electromagnetic clutch for a compressor, wherein the pulley includes an inner hub having a bearing therein and being rotatably connected to a compressor etc., and an outer hub disposed on the periphery of the inner hub with a predetermined gap in order to form an inserting space, into which a field core assembly composing an electromagnetic clutch is inserted, and being formed with a V-profile portion on the outer periphery thereof.

2. Background of the Related Art

Generally, a pulley, which is used to an electromagnetic clutch for a compressor, is rotatably installed on a nose portion being projected from one side of a housing of the compressor, in a state of having a bearing, and transfers the power of a driving source (an engine or a driving motor) to a driving shaft of the compressor according to the discontinuous action of the electromagnetic clutch through a belt. The pulley includes an inner hub, an outer hub, a friction and a V-profile. The inner hub is rotatably connected to the nose portion of the housing in a state of having the bearing. The outer hub is disposed so that an annular space for receiving the field core assembly of the electromagnetic clutch is formed on the periphery of the inner hub. The friction surface connects the two ends of the inner hub and the outer hub so that a hub connected to the driving shaft of the compressor and a disk of a disk assembly are connected and disconnected according to the discontinuous action of the field core assembly. And, the V-profile is installed on the outer periphery of the outer hub in order to be covered with the belt connected to the driving source. That is, the inner hub and the outer hub are disposed in the same direction with respect to the friction surface, therefore, the annular space, which the field core assembly can be inserted therein, is formed between the inner hub and the outer hub.

As a conventional method to manufacture the above-described pulley, there are below two methods described in general. The first method is to perform turning operations using a lathe for a material formed by hot forging or by cold forging. And the second method is to press and to weld a sheave portion worked by the rolling of a rod and a hub portion worked to each other by turning operations of a cold forging material, and so on.

However, the first method is required to consider an allowance for turning operations. Therefore, the cost of the material is wasted, and lots of chips are produced after finishing the turning operations. Further, since there are different forging dies for each kind of a pulley, the turning operations by a manual loading should be required when first rough working. Therefore, the method cannot be achieved automatically and costs of the raw material cannot be saved.

Meanwhile, since the second method requires two individual materials to manufacture one pulley, the cost of the materials is increased and the rolling of the sheave is difficult. Therefore, it is difficult to manufacture a different type of pulley; and thereby, it cannot be expected to develop any new products.

To solve the above-described problems in the method for manufacturing pulleys, many methods and devices for forming a pulley have been recently developed, in which the pulley is manufactured with one material by rolling working, without any cutting. As a representative example, the method and device for forming a pulley is disclosed in the Korean Patent No. 271692.

According to the method and device in the prior art, the cap or the sheet base material is interposed between the rotating spindle and the fixed pin. Afterwards, different types of rollers press the rotating cap and the sheet base material which is rotating, therefore their thickness is decreased. Thereby, the cylindrical projections are formed on the periphery of the fixed pin, and the pulley in which the projections serve as a hub is manufactured.

However, in the prior art, when the pulley is manufactured by forming the cap, the process for forming the works in a cap type is required, and also the process for cutting ends of the formed cylindrical projections is required.

Furthermore, in the prior art, when the pulley is manufactured by forming the sheet material, the sheet material is inserted into the periphery of the pin, and then a press roller bends the edge portion of the sheet material. Afterwards, the sheet material is supported by means of a chuck, and then a cylindrical projection is formed. However, since there is a gap between the sheet material inserted into the periphery of the pin and a movable stop, the sheet works being underneath is movable. Therefore, when the edge portion of the sheet material is bent, the sheet material is slipped during rotation of a spindle. As well, since the press roller presses one side of the edge portion of the sheet material, the other side of the edge portion thereof is lifted. Therefore, the edge portion of the sheet material is not correctly bent; an intermediate hole of the sheet material for receiving the pin is also deformed. Thereby, the rate for producing an inferior product is high.

In the prior art, pulleys manufactured by variety of methods are disclosed. Among them, a pulley was manufactured by a method in that the inner hub and the outer hub are formed in the same direction with respect to the friction surface. However, how the inner hub and the outer hub which are formed in the same direction is not disclosed. In the prior art, the pulley, which composes specifically the electromagnetic clutch for the compressor, in which the inner hub and the outer hub are formed in the same direction with respect to the friction surface, and in which the inserting space for receiving the field core assembly of the electromagnetic clutch is formed between the inner hub and the outer hub, can not be manufactured. It can be known that only a pulley can be manufactured in which the inner hub and the outer hub are formed in opposite direction with respect to the friction surface.

SUMMARY OF THE INVENTION

Accordingly, the present invention is directed to a device for forming a pulley which substantially obviate one or more problems due to limitations and disadvantages of the related art.

An object of the present invention is to provide a device for forming a pulley enabling to easily form the pulley using a rolling process, in which no chips are produced, the pulley composes an electromagnetic clutch for a compressor, and in which an inner hub and an outer hub are formed in the same direction with respect to a friction surface.

The device for forming a pulley of the present invention is to form the first semi-manufactured pulley having the inner and outer hubs which are formed in the same direction, from the plate working piece formed with a hole in intermediate thereof; the device comprises: a first rotating device for rotating the plate working piece according to the first spindle by including the first spindle being rotatably installed on the intermediate thereof, the first centering pin being rotatably installed in the first spindle and guiding the plate working piece formed with the hole in the intermediate thereof, the supporting ring being installed on the periphery of the supporting block in order to support the supporting block being installed on the upper end of the first spindle and to support the plate working piece being placed on the upper surface of the supporting block; the first supporting device including the first supporting pin being installed on the upper portion of the first rotating device enabling to lift and rotate, and the first upper mandrel ring for fixing the plate working piece by being installed on the lower end of the first supporting pin and by pressing the edge of the hole of the plate working piece; the second supporting device being installed on the periphery of the first supporting pin enabling to lift, and including the tandem cylinder ring which supports the formed outer region of the plate working piece; the first pressing means including the first pressing roller which presses the upper surface of the plate working piece toward inside and which forms the inner hub on the periphery of the first upper mandrel ring in drawing process; the second pressing means including the second pressing roller which presses the upper surface of the plate working piece toward the tandem cylinder ring and which forms the outer hub on the periphery of the tandem cylinder ring, and then completes the first semi-manufactured pulley.

In the device for forming a pulley, each pressing roller can be easily substituted. It is preferable that the second supporting device is selectively driven according to the forming method of the outer hub.

The device for forming a pulley according to the present invention is to form the first semi-manufactured pulley formed with the inner/outer hubs so that it has a convex bead portion for forming a V-profile forming portion formed with a recess on the outer periphery surface; the device comprises: the second rotating device being installed on the upper end of the second spindle, and including the second lower mandrel ring which is formed with the annular projection being inserted into the region existing the inner/outer hubs of the first semi-manufactured pulley, and on which the second ejecting pin for guiding the works in order to place safely and to separate in the inside is rotatably installed; the third supporting device being installed on the upper portion of the second rotating device enabling to lift and to rotate, and being provided with the second upper mandrel ring for pressing the inner region of the outer hub of the upper surface of the first semi-manufactured pulley and for fixing the first semi-manufactured pulley; the third pressing means and the fourth pressing means which are respectively provided with the third pressing roller and the fourth pressing roller for gathering the first convex bead portion by gradually pressing the edge of the first semi-manufactured pulley toward inside, and for forming the second convex bead portion to the first convex bead portion.

In the device for forming a pulley of this embodiment, preferably, each pressing roller is easily substituted, and the pressing means can easily perform the different method for forming a pulley if a different type of pressing roller is substituted.

Further, the device for forming a pulley according to the present invention is to form the second semi-manufactured pulley having a V-profile forming portion formed with a recess on the outer periphery thereof from the first semi-manufactured pulley formed with a convex bead portion on the outer periphery surface thereof; the device comprises: the third rotating device for rotating the first semi-manufactured pulley according to the rotation of the third spindle, by including the third spindle being rotatably installed on the intermediate thereof, and by including the third lower mandrel ring, being installed on the upper end of the third spindle, being formed with an annular projection inserted into the region existing between the inner/outer hubs of the first semi-manufactured pulley, and being provided with, inside, the third ejecting pin for guiding the safe placement and separation of the plate working piece; the fourth supporting device being installed on the upper portion of the third rotating device enabling to lift and to rotate, being provided with, on the lower end thereof, the third upper mandrel ring formed with a step portion on the outer periphery surface thereof, in order to fix the first semi-manufactured pulley by pressing the inner region of the outer hub, of the first semi-manufactured pulley, and by being installed with the fourth ejecting pin, in the third upper mandrel ring, for guiding the base material to separate; the fifth pressing means being provided with the fifth pressing roller which presses the convex bead portion forming the edge of the first semi-manufactured pulley toward the end side of the third upper mandrel ring; and the sixth pressing means being provided with the sixth pressing roller which presses the outer periphery surface of the flat bead portion and then completes the second semi-manufactured pulley having a V-profile forming portion formed with a recess on the outer periphery surface thereof.

In the device for forming a pulley, a stepped portion is, respectively, formed on the region corresponding to the stepped portion of the third upper mandrel ring, of the outer periphery surfaces of the each fifth pressing roller and sixth pressing roller. And, an annular bead for forming the recess is protrudently formed on the stepped portion of the sixth pressing roller.

Further, in the device for forming a pulley of this embodiment, an outer supporting ring can be further installed on the periphery of the third lower mandrel ring in order to support the outer region of the outer hub, of the lower surface of the first semi-manufactured pulley. In this case, it is preferable that the outer periphery surface of the fifth pressing roller is flatly formed, and an annular bead for the recess is protrudently formed on the outer periphery surface of the sixth pressing roller.

Further, in the device for forming a pulley of this embodiment, preferably, each pressing roller is easily substituted, and the pressing means can easily perform the different method for forming a pulley if a different type of pressing roller is substituted.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE DRAWING

The first embodiment of forming a pulley will be described with reference to the FIGS. 1 to 5.

The method for forming the pulley includes next three steps. The first step is that the plate working piece P formed with a hole H in the intermediate thereof is fixed to the first forming device 100. The second step is that the plate working piece P is indented and the inner hub 10 is formed by a drawing process. And the third step is that the plate working piece P is indented and the outer hub 20 is formed by a drawing process, then the first semi-manufactured pulley is obtained.

Figure 2:
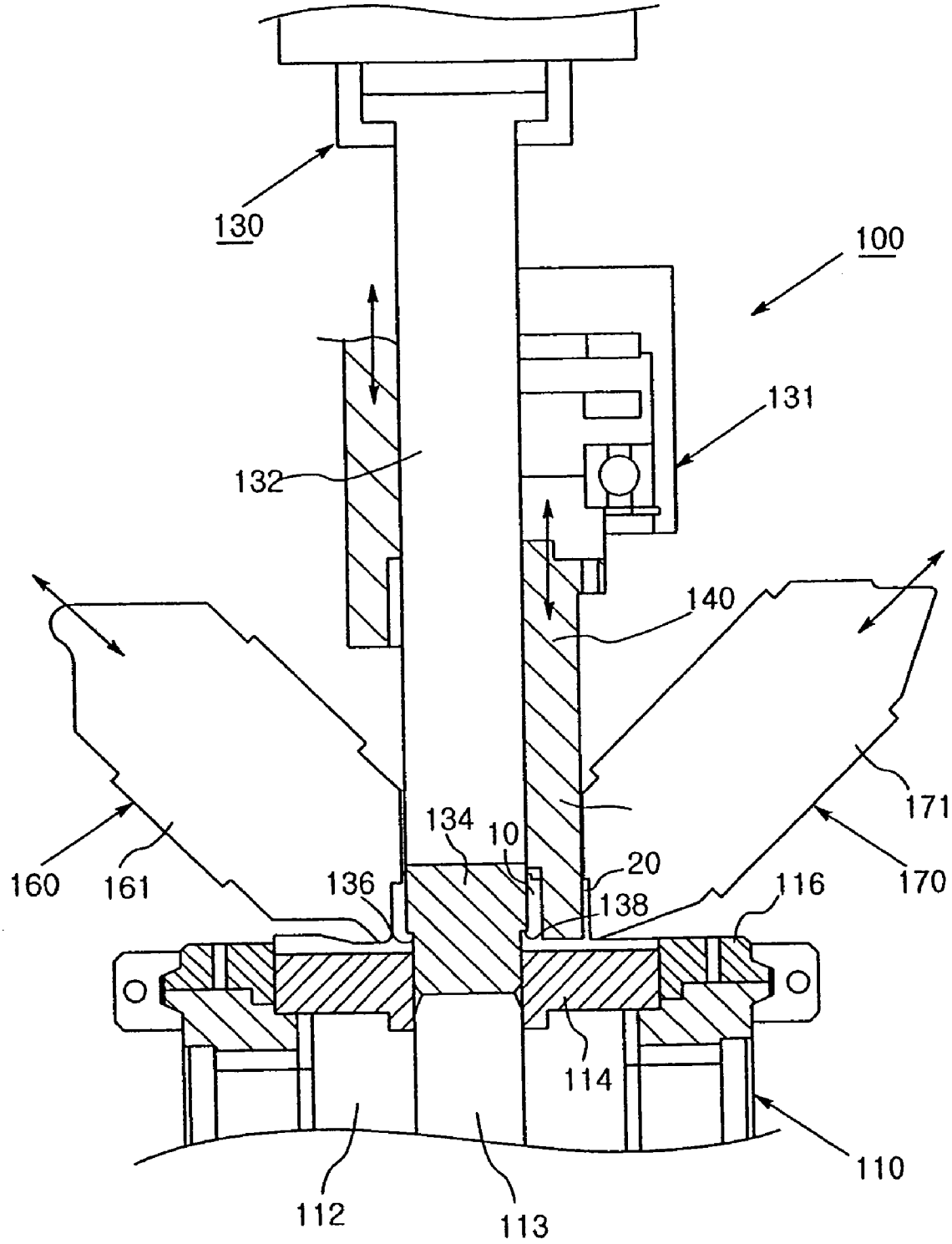
FIG. 2 is a sectional view showing the first forming device for achieving the method for forming the pulley according to the first preferred embodiment of the present invention.

The first forming device 100 for achieving the method for forming the pulley of the present embodiment is shown in FIG. 2. The first forming device 100 forms the plate working piece P formed with the hole H to the first semi-manufactured pulley P1 having the inner hub 10 and the outer hub 20. The first forming device 100 includes the first rotating device 110 for rotating the plate working piece P, the first supporting device 130 for forming the plate working piece P, and the first/second pressing means 160 and 170 for forming the first semi-manufactured pulley P1 having the inner/outer hub 10 and 20, by pressing the plate working piece P.

The first rotating device 110 composing the first forming device 100 includes the first spindle 112 being rotatably installed on the intermediate thereof, the first centering pin 113 being installed, enabling to lift, in the first spindle 112 and guiding the plate working piece P to be safely placed, the supporting block 114 being installed on the upper end of the first spindle 112, and the supporting ring 116 being installed on the periphery of the supporting block 114. The supporting block 114 is rotatably installed together with the first spindle 112 according to the rotation of the first spindle 112. Further, the supporting block 114 is formed with the hollow in the intermediate thereof, and the upper of the first centering pin 113 is lifted up to about half of the hollow. Further, the diameter of the hollow of the supporting block 114 is preferably the same as that of the hole H. The upper surface of the supporting ring 116 is arranged to be higher than that of the supporting block 114, therefore the supporting ring 116 can support the edge of the plate working piece P being placed on the upper surface of the supporting block 114.

The first supporting device 130 composing the first forming device 100 includes the first supporting pin 132 being installed on the upper portion of the first rotating device 110 (specifically, the upper portion of the first spindle 112) enabling to lift and rotate, and the first upper mandrel ring 134 being installed on the lower portion of the first supporting pin 132 and fixing the plate working piece P1 by vertically pushing the edge portion of the hole H of the plate working piece P. The second supporting device 131 is installed on the periphery of the first supporting pin 132 enabling to lift, and is provided with the tandem cylinder ring 140 supporting the outer region of the inner hub 10, which is finished forming, of the plate working piece P. The end 136 having a smaller diameter than other portion is formed on the outer periphery surface of the lower end portion of the first upper mandrel ring 134. Further, the lower end of the first upper mandrel ring 134 pushes the upper end of the first centering pin 113 as well as the end 136 is inserted into the hole H of the plate working piece and into the hollow of the supporting block 114. Thereby, the edge portion of the hole H of the plate working piece P is supported by the stepped portion 138 which is the end portion of the upper side of the end 136.

The first pressing means 160 composing the first forming device 100 is provided with the first pressing roller 161 being installed on the one outside of the first supporting device 130. The first pressing roller 161 presses a part of the upper portion of the plate working piece P toward the inside from the inner surface of the outer hub 20, and forms the inner hub 10 on the periphery of the first upper mandrel ring 134 in drawing process. The second pressing means 170 is provided with the second pressing roller 171 being installed on the other outside of the first supporting device 130. The second pressing roller 171, in a state that the tandem cylinder ring 140 is descended, presses the upper surface of the plate working piece P from the edge to inside and forms the outer hub 20 on the periphery of the tandem cylinder ring 140 in drawing process, therefore the first semi-manufactured pulley P1 is completed. Further, each pressing roller 161 and 171 can be easily substituted with another one, and the second supporting device 131 including the tandem cylinder ring 140 is selectively driven according to the forming method.

The method for forming the first semi-manufactured pulley by the above-mentioned forming device 100 will be explained in detail referring to FIGS. 1 and 2. The plate working piece P formed with the hole H on the intermediate thereof is placed on the position, in which the hole H of the plate working piece P can be guided, in the upper surface of the first centering pin 113. Then, the plate working piece P is safely placed in the space formed between the upper surface of the supporting block 114 of the first forming device 100 and the inner periphery surface of the supporting ring 116 being installed on the periphery of the supporting block 114. When the plate working piece P is safely placed on the upper surface of the supporting block 114, the hole H of the plate working piece P consists with the hollow of the supporting block 114. The first supporting pin 132 is descended to the extent that the lower end of the first upper mandrel ring 134 is descended through the hole H of the plate working piece P and through the hollow of the supporting block 114, pushing the upper end of the first centering pin 113, and then the stepped portion 138 formed on the outer periphery of the first upper mandrel ring 134 pushes the edge of the plate working piece P. The edge of the plate working piece P is grasped between the stepped portion 138 formed on the outer periphery surface of the first upper mandrel ring 134 and the supporting block 114, therefore the plate working piece P can be fixed.

Next, the inner hub 10 is formed on the periphery of the first upper mandrel ring 134 in drawing process by operating the first pressing means 160 so that the plate working piece P is rotated by the rotation of the first spindle 112 as well as the first pressing roller 161 presses the outer hub 20, of the upper surface of the plate working piece P, when the outer hub is formed, toward the inside from the inner starting surface. In this state, the first pressing roller 161 is returned to an initial position, afterward the second supporting device 131 is descended. Thereby, the outside of the inner hub 10 of the plate working piece P is supported by means of the tandem cylinder ring 140.

Next, the second pressing means 170 is operated, so that the second pressing roller 171 presses the upper surface of the plate working piece P towards inside, to form the outer hub 20 on the periphery of the tandem cylinder ring 140 in drawing process. Thereby, the first semi-manufactured pulley P1 is completed. The first semi-manufactured pulley P1, being formed in that the inner hub 10 and the outer hub 20 are formed in the same direction with respect to the friction connecting the inner hub 10, can be obtained. Further, if the second pressing roller 171, the tandem cylinder ring 140 and the first supporting device 130 are returned to their original position in order, and the supporting block 114 is lifted by the hydraulic cylinder (not shown) being installed on the lower portion, the first semi-manufactured pulley P1 being safely placed on the upper portion of the supporting block 114 can be upwardly separated.

Further, the method for forming a pulley can include additional step in which the first semi-manufactured pulley P1 is formed to be the second semi-manufactured pulley having the V-profile forming portion 70, being formed with a recess on the outer periphery surface thereof. That is, the method for forming a pulley according to the present embodiment, as shown in FIGS. 1, 3 and 4, can further include next steps.

A step is to fix the first semi-manufactured pulley P1 to the second forming device 200 so that the first semi-manufactured pulley P1 rotates according to the second spindle 212. Another step is to form the first convex bead portion 40 and the second convex bead portion 50 by pressing the first semi-manufactured pulley P1. Still another step is to fix the semi-manufactured pulley P1 formed with the second convex bead portion 50 to the third forming device 300 so that the semi-manufactured pulley P1 rotates according to the third spindle 312 of the third forming device 300. Still another step is to form the flat bead portion 60 by pressing the second convex bead portion 50. Further, still another step is to obtain the second semi-manufactured pulley P2 having the V-profile forming portion 70, being formed with the recess 80 on the outer periphery surface thereof, by pressing the flat bead portion 60.

Figure 3:
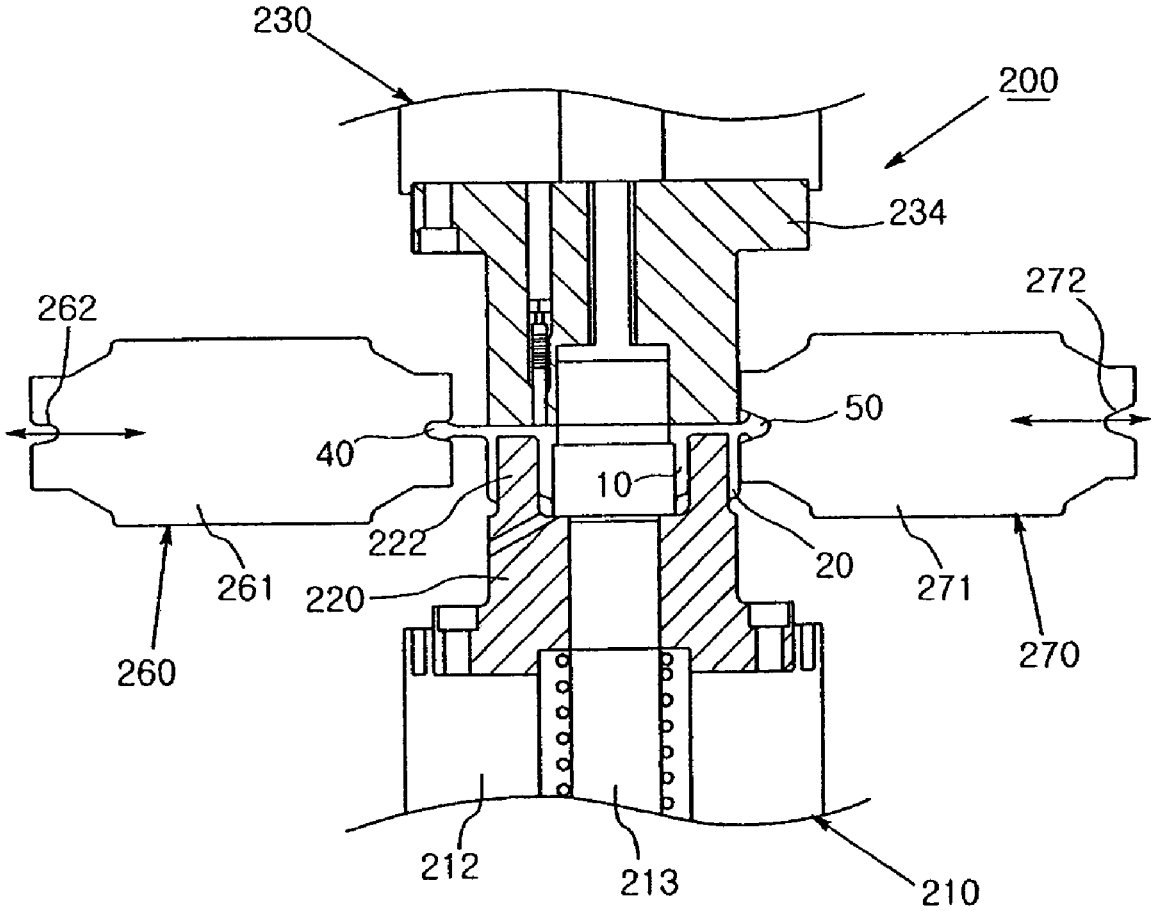
FIG. 3 is a sectional view showing the second forming device for achieving the method for forming the pulley according to the first preferred embodiment of the present invention.
Figure 4:
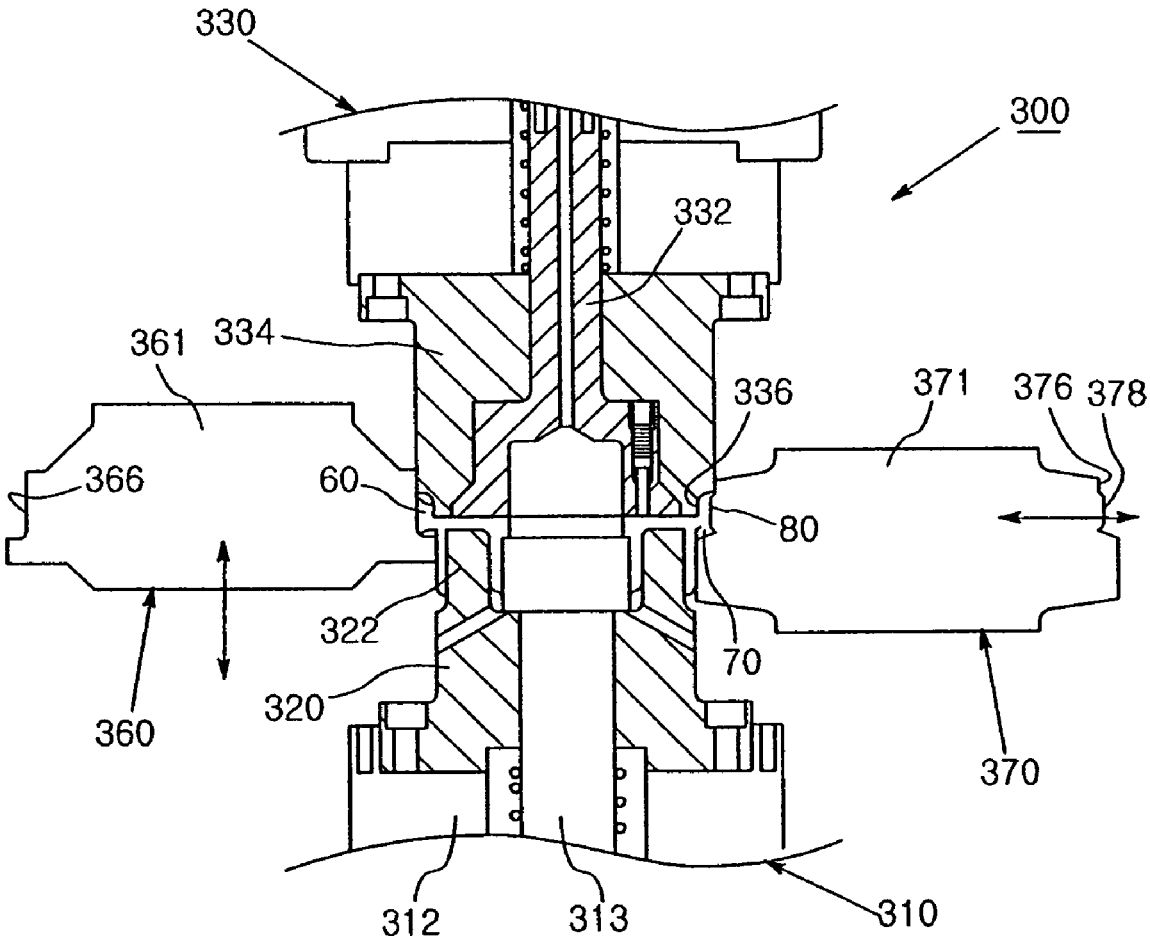
FIG. 4 is a sectional view showing the third forming device for achieving the method for forming the pulley according to the first preferred embodiment of the present invention.

The second forming device 200 used to manufacture the second semi-manufactured pulley P2 is shown in FIG. 3. That is, the second forming device 200 forms the first convex bead portion 40 and the second convex bead portion 50 in order. This step is an intermediate step to form the V-profile forming portion 70 being formed with the recess 80 on the outer periphery surface the first semi-manufactured pulley P1. The second forming device 200 includes the second rotating device 210 for rotating the first semi-manufactured pulley P1, the third supporting device 230 for supporting the first semi-manufactured pulley P1, the third pressing means 260 for forming the first convex bead portion 40 on the first semi-manufactured pulley P1, and the fourth pressing means 270 for forming the second convex bead portion 50 from the first convex bead portion 40.

The second rotating device 210 includes the second spindle 212 being rotatably installed on the intermediate thereof, the second lower mandrel ring 220 being installed on the upper end of the second spindle 212 in order to rotate together with the second spindle 212 according to the second spindle 212 and being formed with an annular projection 222 which is inserted into the region existing between the inner hub 10 and the outer hub 20 of the first semi-manufactured pulley P1 and grasps the first semi-manufactured pulley P1, and the second ejecting pin 213 being installed on the inside of the second lower mandrel ring 220 enabling to lift.

The third supporting device 230 is installed on the upper portion of the second rotating device 210 (specifically, the upper portion of the second spindle 212), enabling to lift and rotate. On the lower end of the third supporting device 230, is provided the second upper mandrel ring 234 for grasping the first semi-manufactured pulley P1 by pressing the inner region of the outer hub 20, of the upper surface of the first semi-manufactured pulley P1. The outer diameter of the second upper mandrel ring 234 is preferably the same as that of the outer hub 20.

The third pressing means 260 is provided with the third pressing roller 261, which is installed on one outside of the second lower mandrel ring 220 and the second upper mandrel ring 234, and which gathers the first convex bead portion 40 by pressing the edge of the first semi-manufactured pulley P1.

Further, the fourth pressing means 270 is provided with the fourth pressing roller 271, which is installed on the other outside of the second lower mandrel ring 220 and the second upper mandrel ring 234, and which forms the second convex bead portion 50 by pressing the first convex bead portion 40 toward inside in order to be more close to the outer hub 20. The annular groove 262 for gathering the first convex bead portion 40 is formed on the outer periphery surface of the third pressing roller 261. And, the annular recess 272 for forming the second convex bead portion 50 is formed on the outer periphery surface of the fourth pressing roller 271. The annular grooves 262 and 272 are preferably extended toward the open portion. And the annular recess 272 of the fourth pressing roller 271 is greater than the annular groove 262 of the third pressing roller 261.

Further, the third forming device 300 used to manufacture the second semi-manufactured pulley P2 is shown in FIG. 4. The third forming device 300 forms the second semi-manufactured pulley P2 having the V-profile forming portion 70 formed with the recess 80 on the outer periphery surface thereof from the first semi-manufactured pulley P1 having the inner/outer hubs 10 and 20 and the second convex bead portion 50.

The third forming device 300 is provided with the third rotating device 310 for rotating the first semi-manufactured pulley P1, the fourth supporting device 330 for supporting the first semi-manufactured pulley P1, the fifth pressing means 360 for forming the flat bead portion 60 by pressing the second convex bead portion 50 of the first semi-manufactured pulley P1, and the sixth pressing means 370 for forming the second semi-manufactured pulley P2 having the V-profile forming portion 70 formed with the recess 80 on the outer periphery surface thereof by pressing the flat bead portion 60.

The third rotating device 310 is provided with the third spindle 312 being rotatably installed on the intermediate thereof, the third lower mandrel ring 320 being installed on the upper end of the third spindle 312 in order to rotate together with the third spindle 312 according to the rotation of the spindle 312 and being formed with the annular projection which is inserted into the region existing between the inner/outer hubs 10 and 20 and which grasps the first semi-manufactured pulley P1, and the third ejecting pin 313 being installed on the inside of the third lower mandrel ring 320 enabling to lift.

The fourth supporting device 330 is rotatably installed at an upper portion of the third rotating device 310, more particularly an upper portion of the third spindle 312, to ascend and descend along with the third rotating device 310. The third rotating device 310 has the third upper mandrel ring 334 at a lower end thereof which presses an inner region of the outer hub 20 on the upper surface of the first semi-manufactured pulley P1 to fix the first semi-manufactured pulley P1. Further, a step portion 336 is formed on an outer peripheral surface of the lower end of the third upper mandrel ring 334. Also, a fourth ejecting pin 332 is installed in the third upper mandrel ring 334 to ascend and descend along the third upper mandrel ring 334.

The fifth pressing means 360 of the third forming device 300 has a fifth pressing roller 361 which is installed at an outer portion of the second lower mandrel ring 320 and the third upper mandrel ring 334 in order to press the block bead portion to the step portion 336 of the third upper mandrel ring 334 to form the flat bead portion 60. Further, the sixth pressing means 370 is provided with a sixth pressing roller 371 which is installed at another outer portion of the third lower mandrel ring 320 and the third upper mandrel ring 334 so as to complete the second semi-manufactured pulley P2 having a V-profile portion 70 in which grooves 80 are formed on outer peripheral surface thereof. Preferably, the step portions 366 and 376 are sequentially formed at a region of the respective outer peripheral surface of the fifth and sixth pressing rollers 361 and 371 to be corresponding to the step portion 336 of the third upper mandrel ring 334. As upper ends of the step portions 366 and 376 formed on the pressing rollers 361 and 371 come in contact with an outer peripheral surface over the step portion 336 of the third upper mandrel ring 334 while lower ends of the pressing rollers 361 and 371 respectively being contacted with the outer hub, a predetermined space can be defined by means of the step portion 336 of the third upper mandrel ring 334 and the step portions 366 and 376 of the pressing rollers 361 and 371. The space is used to form the flat bead portion 60 and the V-profile forming portion 70. Also, an annular bead 378 is projected from the step portion 376 of the sixth pressing roller 371 in order to form the grooves 80.

Figure 5:
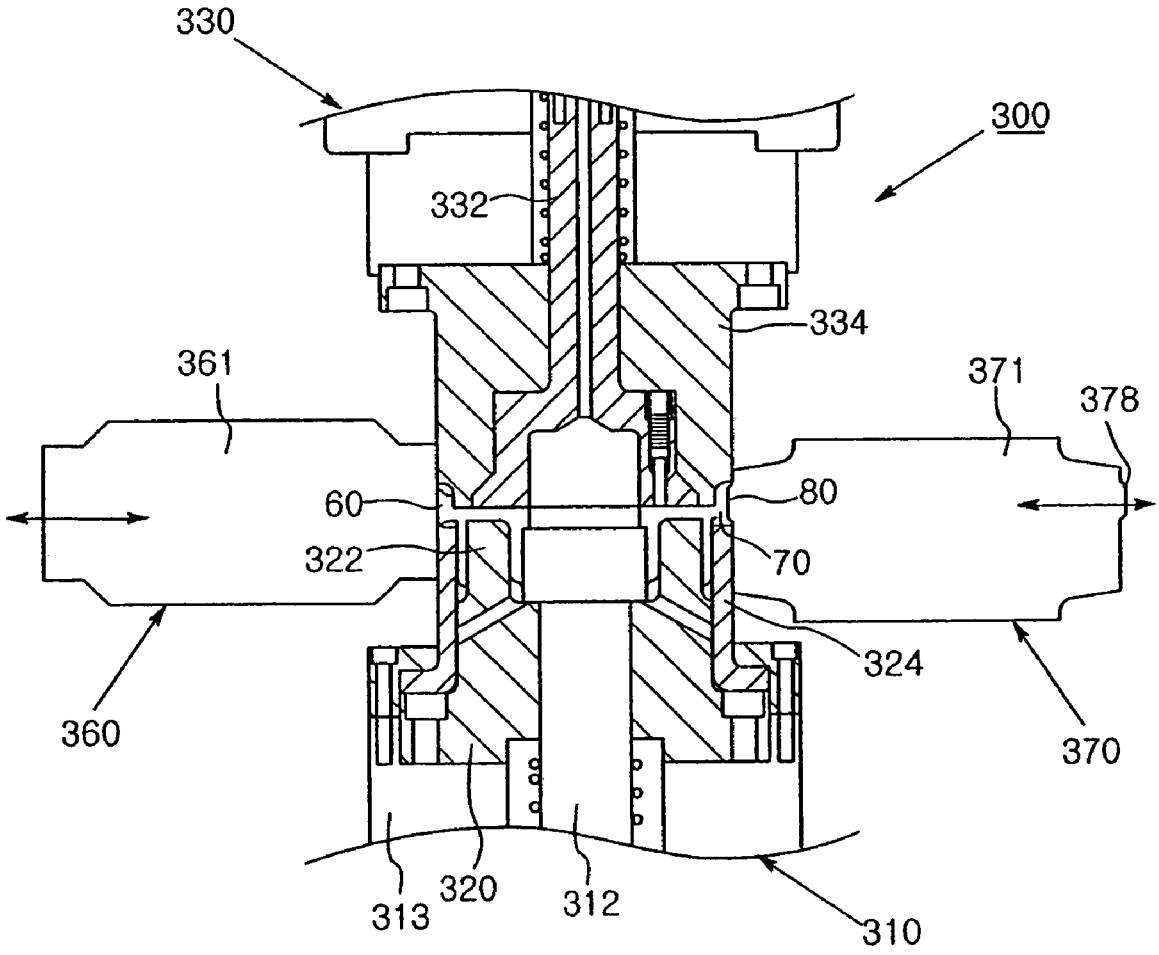
FIG. 5 is a sectional view showing another embodiment of the third forming device for achieving the method for forming the pulley according to the first preferred embodiment of the present invention.

Furthermore, the pressing rollers 361 and 371 having another structure can be adopted to the third forming device 300. In this case, as shown in FIG. 5, an outer supporting ring 324 can be further installed around the third lower mandrel ring 320 so as to support an outer region of the outer hub 20 on a lower surface of the first semi-manufactured pulley P1. The outer supporting ring 324 preferably has the same outer diameter as that of the third upper mandrel ring 334. Also, the respective outer peripheral surface of the fifth and sixth pressing rollers 361 and 371 is flat surface from which the annular bead 378 is projected in order to form the grooves 80 on the flat peripheral surface of the sixth pressing roller 371. Since the upper ends of the pressing roller 361 and 371 can come in contact with the outer peripheral surface over the step portion 336 of the third upper mandrel ring 334 while the lower ends of the pressing rollers 361 and 371 being in contact with the peripheral surface of the outer supporting ring 324, therefore, predetermined spaces can be respectively defined by means of the pressing rollers 361 and 371, the step portion 336 of the third upper mandrel ring 334 and the upper end of the outer supporting ring 324. Each space can be used to form the flat bead portion 60 and the V-profile forming portion 70.

The method for forming the second semi-manufactured pulley P2 with the first semi-manufacture pulley P1 by means of the second and third forming devices 200 and 300 will be described in detail with reference to FIGS. 1 and 3 to 5. In the state that the second ejecting pin 213 is ascended, firstly, the first semi-manufactured pulley P1 is placed on the second ejecting pin 213 which in turn is descended so as to settle the first semi-manufactured mandrel ring P1 on the second rotating device 210 in order that the region between the inner and outer hubs 10 and 20 of the first semi-manufactured pulley P1 is inserted in the projection 222 formed on the second lower mandrel ring 220. Then, the third supporting device 230 is descended so that the lower end of the second upper mandrel ring 234 presses the upper surface, i.e., the inner region of the outer hub 20 of the first semi-manufactured pulley P1, resulting in fixing the first semi-manufactured pulley P1. That is, the first semi-manufactured pulley P1 is disposed between the second lower mandrel ring 220 and the second upper mandrel ring 234. Next, while the first semi-manufactured pulley P1 is rotated along with the second spindle 212, the third pressing roller 261 presses the edge of the rotating first semi-manufactured pulley P1 inwardly so as to firstly form the first convex bead portion 40 to be thick. Continuously, after the third pressing roller 261 is returned to an initial position, the first convex bead portion 40 is pressed by means of the fourth pressing roller 271 toward the outer hub 20 so as to form the second convex bead portion 50. In this state, after the fourth pressing roller 271 and the third supporting device 230 are sequentially returned to the initial position, the second ejecting pin 213 is ascended. Thus, the first semi-manufactured pulley P1 settled on the second rotating device 210 can be released upwardly.

Then, the first semi-manufactured pulley P1 having the second convex bead portion 50 formed thereon is settled on the third forming device 300, as described above. That is, in the state that the third ejecting pin 313 is ascended, the third ejecting pin 313 is descended as soon as the first semi-manufactured pulley P1 is placed on the third ejecting pin 313, so that the region defined by means of the inner and outer hubs 10 and 20 of the first semi-manufactured pulley P1 is inserted in the projection 322 of the third lower mandrel ring 320 of the third forming device. Thereby, the first semi-manufactured can be settled on the third rotating device 310. Next, the fourth supporting device 330 is descended in order that the lower ends of the third upper mandrel ring 334 and the four ejecting pin 332 concurrently push the upper surface, i.e., the inner region of the outer hub 20, of the first semi-manufactured pulley P1 to fix the first semi-manufactured pulley P1. That is, the first semi-manufactured pulley P1 is disposed between the third lower mandrel ring 320 and the third upper mandrel ring 334. While the first semi-manufactured pulley P1 is rotated along with the third spindle 312, the fifth pressing roller 361 presses the second convex bead portion 50 of the rotating first semi-manufactured pulley P1 to form the flat bead portion 60. Continuously, after the fifth pressing roller 361 is returned to the initial position, the flat bead portion 60 is pressed by means of the sixth pressing roller 371 to form the second semi-manufactured pulley P2 having the V-profile forming portion 70 in which the grooves 80 are formed on the outer peripheral surface thereof. When the third ejecting pin 313 is ascended after the sixth pressing roller 371 and the fourth supporting device 330 are sequentially returned to the initial position, the second semi-manufactured pulley P2 settled on the third rotating device 310 can be released upwardly. At this time, the fourth ejecting pin 332 prevents the second semi-manufactured pulley P2 from ascending along with the fourth supporting device 330 as the second semi-manufactured pulley P2 is attached to the fourth supporting device 330 during the ascend of the fourth supporting device 330.

Figure 1:
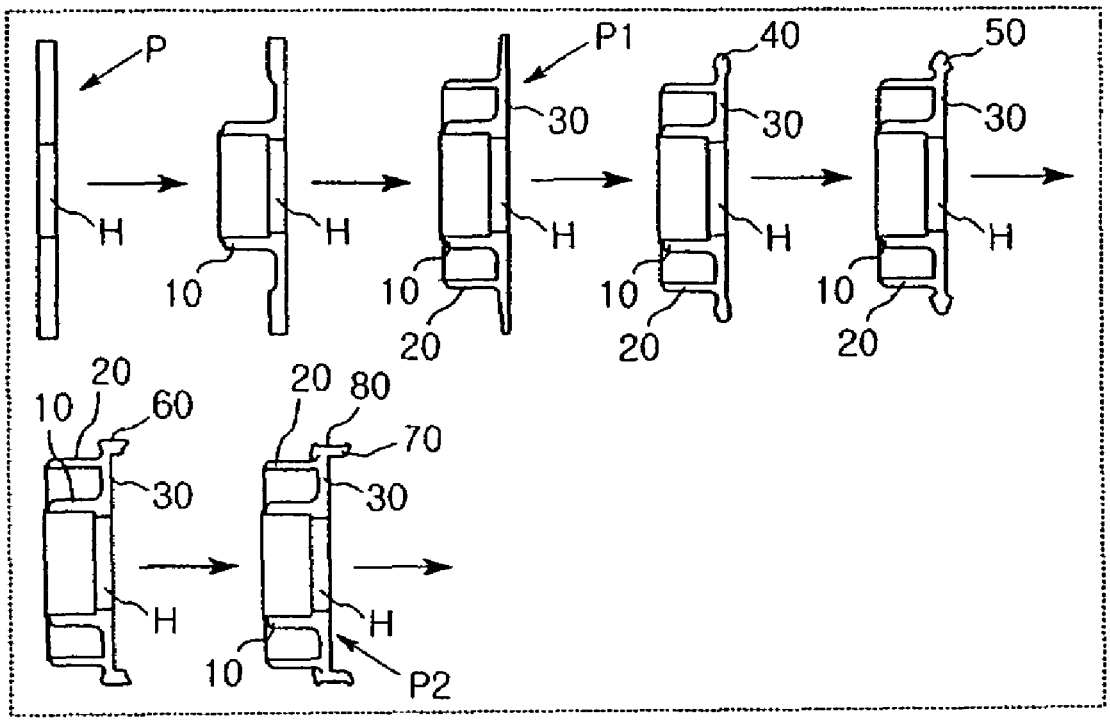
FIG. 1 is a view showing the whole process to manufacture a pulley from a plate working piece by a method for forming a pulley, in order, following to the forming state, according to the first preferred embodiment of the present invention.
Figure 1:
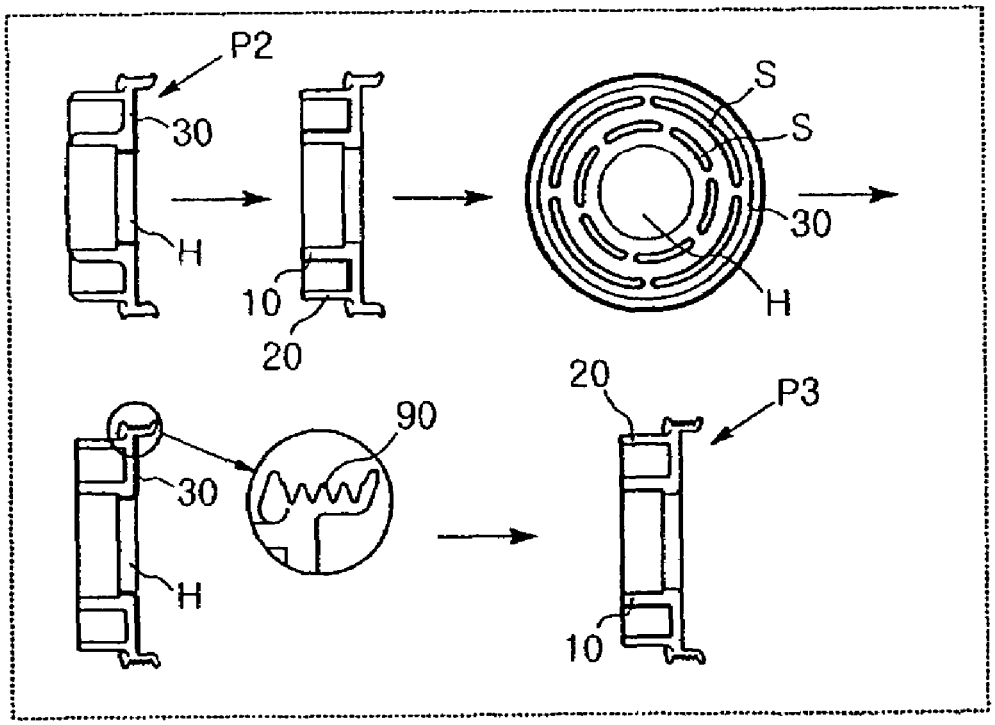

As described above, the second semi-manufactured device P2 is established as a pulley P3 after a post-treatment step marked by a dot lined-box in FIG. 1. That is, the post-treatment step includes a first lather-turning step for forming a friction surface 30 connecting the inner hub 10 to the outer hub 20 and hole H, a second lather-turning step for forming an inner surface of the space formed between the inner and outer hubs 10 and 20, a piercing step for forming slots S on the friction surface 30 to be concentric with one another in order to generate magnetic flux, a first finishing step for processing the grooves 80 in order for belts to be wound thereon so as to complete the V-profile 90 and for finishing the friction surface 30 and the hole H, and a second finishing step for finishing inner and outer peripheral surfaces of the inner hub 10 and the inner peripheral surface of the outer hub 20. Those steps are carried out sequentially, thereby obtaining the pulley P3 for a compressor.

A second method of forming the pulley will be described with reference to FIGS. 6 to 9. The forming device which carries out the method for forming the pulley according to this embodiment of the present invention has the same structure as the first, second and third forming devices 100, 200 and 300. The tandem cylinder ring 140 and the second pressing means 170 are not used. The third and fourth pressing means and the second lower mandrel ring respectively has a different shape from the third and fourth pressing means 260 and 270 of the first forming device 200, and the second lower mandrel ring 320 of the third forming device 300. Therefore, the corresponding element is indicated by the same reference numeral even though the corresponding element has a different structure from that of in the first embodiment.

The method for forming the pulley according to the second method comprises a step for fixing a plate working piece P having a hole H at a center thereof to a first forming device 100, a step for pressing the plate working piece P by means of the first forming device 100 to form the inner hub 10, a step for fixing the plate working piece having the inner hub formed therein to the second forming device 200, a step for pressing an edge of the plate working piece P fixed to the second forming device 200 to form a convex bead portion 50', and a step for forming the convex bead portion 50' in a direction to the inner hub 10 to make a first semi-manufactured pulley P1.

Figure 6:
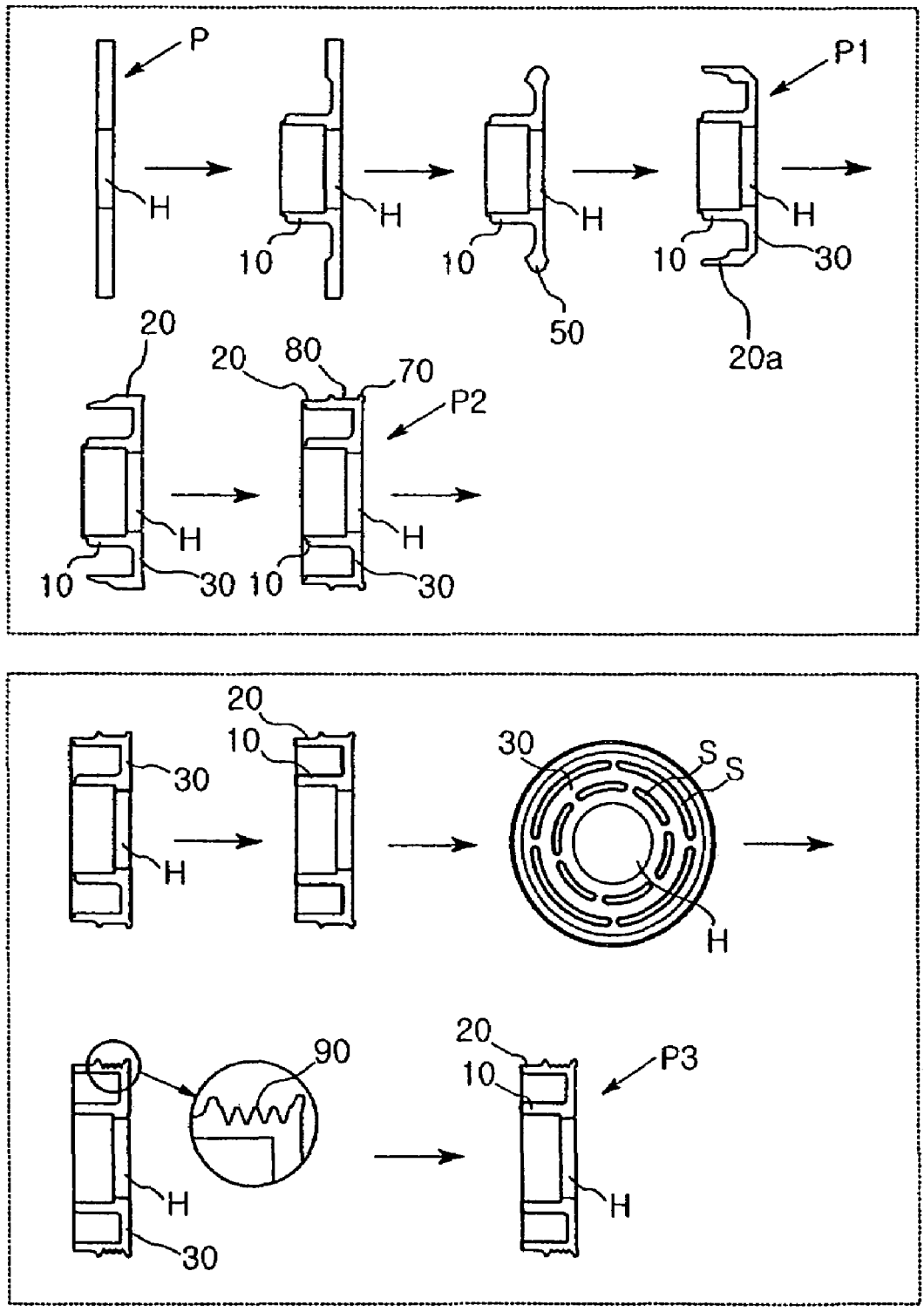
FIG. 6 is a view showing the whole process to manufacture a pulley from a plate working piece by a method for forming a pulley, in order, following to the forming state, according to the second preferred embodiment of the present invention.
Figure 7:
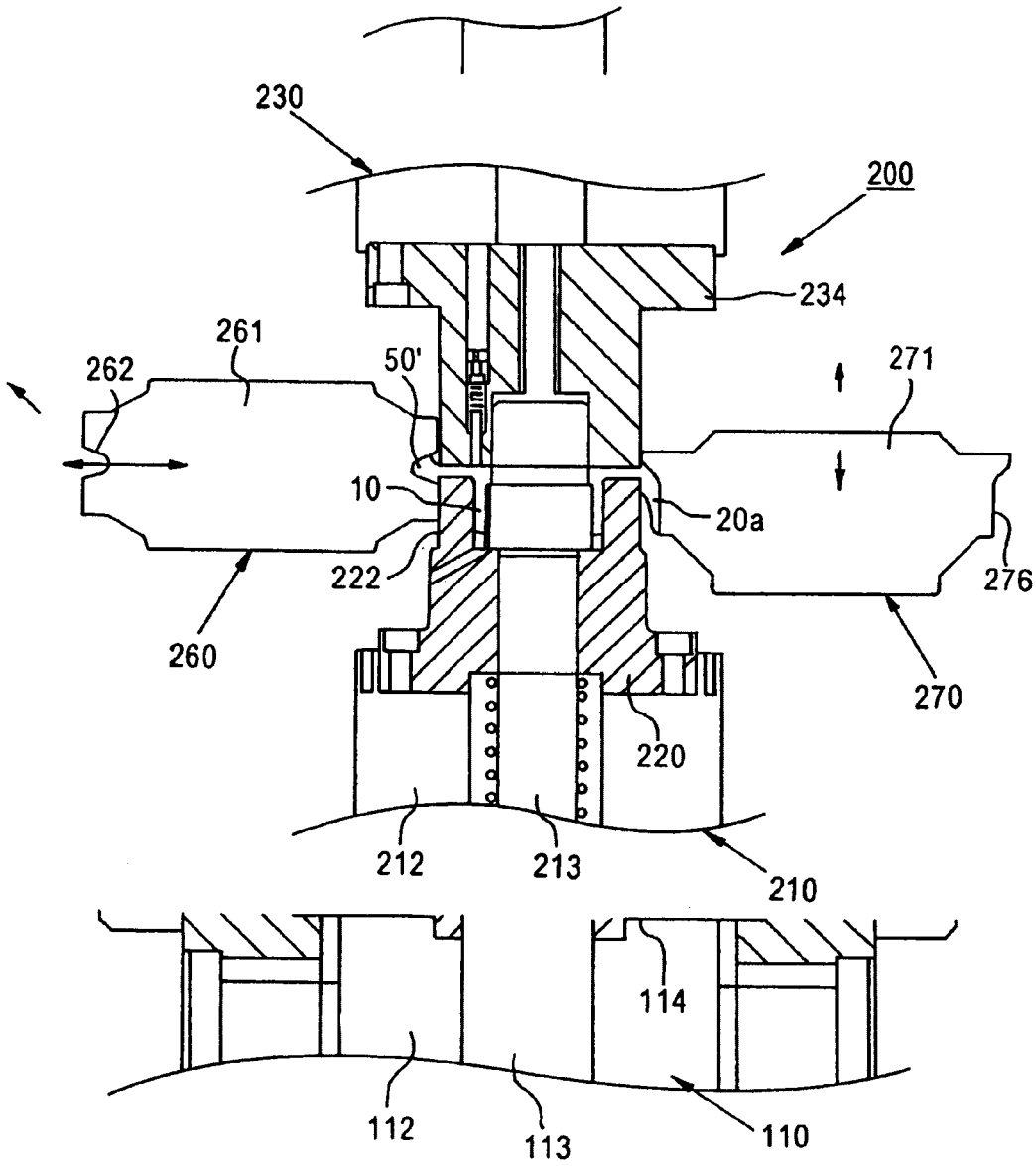
FIG. 7 is a sectional view showing the first forming device for achieving the method for forming the pulley according to the second preferred embodiment of the present invention.

The method for forming the plate working piece P by means of the first and second forming devices 100 and 200 to make the first semi-manufactured pulley P1 will be described in detail with reference to FIGS. 6 to 8. Firstly, the first forming device 100 is settled and fixed similarly to the first embodiment (see FIG. 7). Then, the first pressing means 160 is operated to press an edge of an upper surface of the plate working piece P inwardly to form an inner hub 10 around a first upper mandrel ring 134, while the plate working piece P is rotated along with a first spindle 112. In this state, the first pressing roller 161 and the first supporting device 130 are returned to the initial position in order, while a supporting block 114 is pushed upwardly by means of a hydraulic cylinder (not shown) installed at a lower portion. Thereby, the inner hub 10 is formed so that the plate working piece P placed on the first rotating device 110 can be released.

Figure 8:
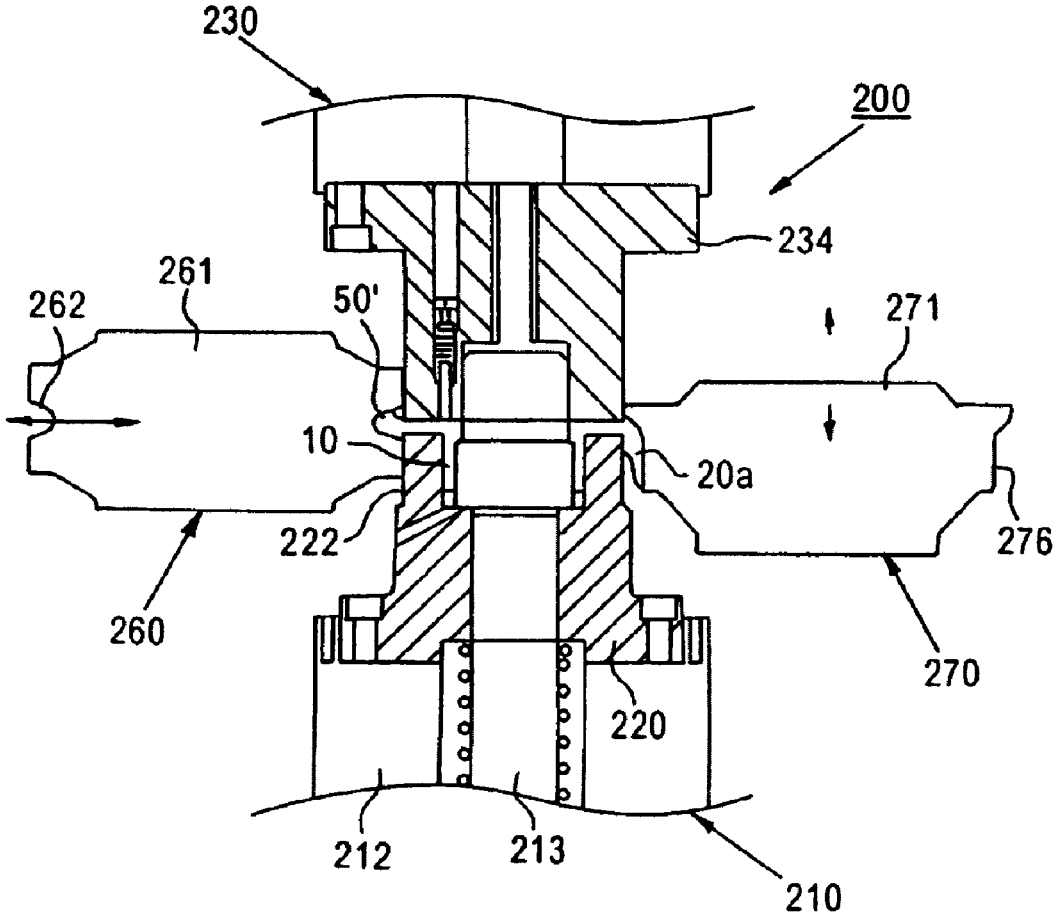
FIG. 8 is a sectional view showing the second forming device for achieving the method for forming the pulley according to the second preferred embodiment of the present invention.

Next, the plate working piece P having the inner hub 10 as described above is settled on the second rotating device 210 of the second forming device 200, similarly to the first embodiment (see FIG. 8). That is, the inner hub 10 can be inserted in a hollow cavity of the annular projection 222 to settle the plate working piece P so that the outer region of the inner hub 10 on the lower surface of the plate working piece P is supported by means of the annular projection 222 of the second lower mandrel ring 220. In this state, the third supporting device 230 is descended in order that the lower end of the second upper mandrel ring 234 presses the upper surface of the plate working piece P. That is, the plate working piece P is disposed and fixed between the second lower mandrel ring 220 and the second upper mandrel ring 234. Next, the third pressing roller 261 presses an edge of the plate working piece P rotating along with the second spindle 212 inwardly to form the convex bead portion 50'. In this state, the third pressing roller 261 is returned to the initial position and the fourth pressing roller 271 is descended to press the convex bead portion 50' smoothly in the direction to the inner hub 10 so as to form the outer hub forming portion 20*a*, thereby manufacturing the first semi-manufactured pulley P1. When the fourth pressing roller 271 and the third supporting device 230 are returned to the initial position in turn before the second ejecting pin 213 is ascended, the first semi-manufactured pulley P1 placed on the second rotating device 210 can be released upwardly.

In the method for forming the pulley, the annular grooves 262 are formed on the outer peripheral surface of the third pressing roller 261 to form the convex bead portion 50', while the step portion 276 is formed at a portion of the outer peripheral surface of the fourth pressing roller 271 to be corresponding to the projection 222.

Figure 9:
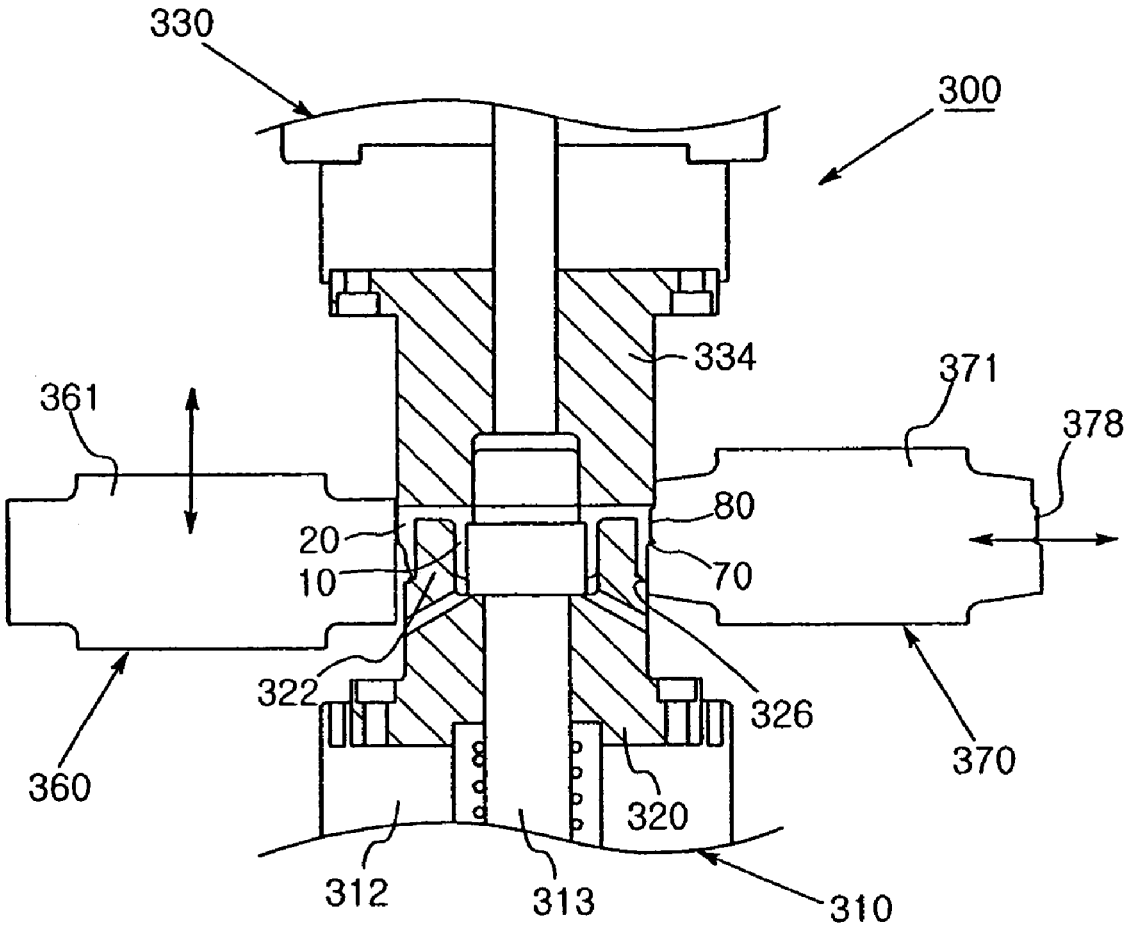
FIG. 9 is a sectional view showing the third forming device for achieving the method for forming the pulley according to the second preferred embodiment of the present invention.

Meanwhile, the second method for forming the pulley further includes a step of forming the second semi-manufactured pulley P2 having the V-profile forming portion 70 in which the grooves 80 are formed on the outer peripheral surface by using the first semi-manufactured pulley P1. That is, as shown in FIGS. 6 and 9, the method for forming the pulley according to this embodiment of the present invention further includes a step of fixing the first semi-manufactured pulley P1 to the third forming device 300, a step of pressing the outer hub forming portion 20a of the first semi-manufactured pulley P1 to form the outer hub 20, and a step of forming the grooves 80 on the outer peripheral surface of the outer hub 20 to make the second semi-manufactured pulley P2 having the V-profile forming portion 70.

The method for forming the second semi-manufactured pulley P2 with the first semi-manufactured pulley P1 by means of the third forming device 300 will be described in detail with reference to FIGS. 6 and 9. Firstly, the first semi-manufactured pulley P1 is placed on the third rotating device 310 in order that the projection 322 formed on the third lower mandrel ring 320 is inserted in the region defined by the inner hub 10 and the outer hub forming portion 20a in such a manner as that of the first embodiment of the present invention. In this state, the first semi-manufactured pulley P1 is disposed between the third lower mandrel ring 320 and the third upper mandrel ring 334. Next, the first semi-manufactured pulley P1 is rotated along with the third spindle 312, while the fifth pressing roller 361 presses the outer hub forming portion 20*a* of the rotating first semi-manufactured pulley P1 smoothly to form the outer hub 20. Then, the fifth pressing roller 261 is returned to the initial position. The outer peripheral surface of the outer hub 20 is pressed by means of the sixth pressing roller 371 to complete a shape of the outer hub 20 in the space defined by means of the outer peripheral surface and the step portion 326 of the second lower mandrel ring 320 and the sixth pressing roller 371 while to form the grooves 80 on the outer peripheral surface of the second lower mandrel ring 320, thereby making the second semi-manufactured pulley P2 having the V-profile forming portion 70. When the sixth pressing roller 371 and the fourth supporting device 330 are returned to the initial position in turn before the third ejecting pin 313 is ascended, furthermore, the second semi-manufactured pulley P2 placed on the third rotating device 310 can be released upwardly.

In the second method for forming the pulley, the outer peripheral surface of the fifth pressing roller 361 is formed to be flat. The annular bead 378 is projected on the outer peripheral surface of the sixth pressing roller 371 to form the grooves 80.

In the second method for forming the pulley, the second semi-manufactured pulley P2 is processed in the post-treatment step similar to that of the first embodiment to manufacture the pulley P3 for the compressor finally. Since this step is depicted in a dot-lined box in FIG. 7, the description of this step will be omitted.

In the device for forming the pulley according to the present invention constructed as described above, a separate step for forming a cap with the material and a step for cutting an edge of the cylindrical projection can be removed, thereby simplifying the processes for forming the pulley.

Furthermore, since the plate working piece and the first semi-manufactured pulley cannot be shaken but fixed tightly at the step for forming the plate working piece into the first semi-manufactured pulley or at the step for making the second semi-manufactured pulley by using the first semi-manufactured pulley, the final pulley can be precisely formed. Thus, the ratio of poor products can be reduced, and the quality of the pulley can be improved.

In addition, since the pulley in which the inner and outer hubs are formed in the same direction to the friction surface can be formed by non-cutting manner, for example rolling, the method for forming the pulley according to the present invention can increase the productivity of the pulley remarkably as well as reducing the cost of manufacturing the pulley in comparison with the method for forming the pulley according to the conventional art such as the method for forming the pulley by lather turning the material formed by means of hot forging or cold forging and the method for forming the pulley by fitting or welding a pulley block formed by rolling to a hub portion by the lather turning the cold forged-material.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus for forming a first semi-manufacture pulley having an inner hub and an outer hub forming portion, comprising:

a first rotating device for rotating a plate working piece along with a first spindle, the first rotating device including the first spindle rotatably installed at a center thereof, a first centering pin, that is elevated in the first spindle, for guiding an opening of the plate working piece to settle the plate working piece at a predetermined position, a supporting block around an upper end of the first spindle, and a supporting ring around the supporting block for supporting an edge of the plate working piece placed on an upper surface of the supporting block;

a first supporting device having a first supporting pin rotatably positioned at an upper portion of the first rotating device arranged to ascend and descend along the first rotating device, the first supporting device including a first upper mandrel ring located at a lower end of the first supporting pin to extend through the opening of the plate working piece for pressing an upper end of the first centering pin, while pressing an edge of the opening of the plate working piece with the step portion formed on the lower end of the outer peripheral surface thereof in order to fix the plate working piece;

a first pressing means having a first pressing roller for pressing an upper surface of the plate working piece inwardly so as to form the inner hub of the first semi-manufactured pulley around the first upper mandrel ring;

a second rotating device including a second spindle rotatably positioned at a center thereof, a second lower mandrel ring at an upper end of the second spindle and having an annular projection on an upper surface thereof to be inserted in a region defined by the inner and outer hubs of the first semi-manufactured pulley, and a second ejecting pin positioned in the second lower mandrel ring to ascend and descend along the second lower mandrel ring, for settling and releasing the first semi-manufactured pulley, the second rotating device being arranged for causing the first semi-manufactured pulley to rotate with the second spindle;

a second supporting device rotatably positioned at an upper portion of the second rotating device to ascend and descend along the second rotating device and having a second upper mandrel ring at a lower end thereof far fixing the first semi-manufactured pulley by pressing an inner region of the outer hub of the first semi-manufactured pulley; and a second and third pressing means of the apparatus respectively having a second pressing roller and a third pressing roller for sequentially pressing an edge of the first semi-manufactured pulley inwardly to form a convex bead portion.

2. the apparatus of claim 1, wherein on an outer peripheral surface of the third pressing roller includes annular grooves for collecting a convex bead portion, and an outer peripheral surface of the third pressing roller includes annular grooves for collecting an outer hub forming bead portion.

3. The apparatus of claim 1, further comprising:

a third rotating device which includes a third spindle rotatably installed at a center thereof, a third lower mandrel ring positioned at an upper end of the third spindle and having an annular projection formed on an upper surface thereof to be inserted in a region defined by the inner and outer hubs of the first semi-manufactured pulley, and a third ejecting pin positioned in the third lower mandrel ring to ascend and descend along the third lower mandrel ring, for settling and releasing the first semi-manufactured pulley, the third rotating device being arranged for causing the first semi-manufactured pulley to rotate along with the third spindle;

a third supporting device rotatably positioned at an upper portion of the third rotating device to ascend and descend along the third rotating device and having a third upper mandrel ring, including a step at a lower end of an outer peripheral surface thereof, for fixing the first semi-manufactured pulley by pressing an inner region of the outer hub of the first semi-manufactured pulley, the fourth supporting device having a fourth ejecting pin positioned in the third upper mandrel ring for separating the second semi-manufactured pulley from the third upper mandrel ring after the second semi-manufactured pulley has been completed;

a fourth pressing means which includes a fourth pressing roller for pressing an outer hub forming portion which is an edge of the first semi-manufactured pulley to the step of the third upper mandrel ring for forming a flat bead portion; and a fifth pressing means of the apparatus having a fifth pressing roller for pressing an outer peripheral surface of the flat bead portion for forming the second semi-manufactured pulley so the second semi-manufactured pulley has a V-profile forming portion in which grooves are formed on an outer peripheral surface.

4. The apparatus of claim 3, wherein at least one annular bead projects from the outer peripheral surface of the fifth pressing roller for forming the grooves.

5. The apparatus of claim 4, further comprising a step portion at a lower end of the third lower mandrel ring which comes in contact with the outer hub.

* * * * *